United States Patent [19]

North

[11] Patent Number: 4,974,889

[45] Date of Patent: Dec. 4, 1990

[54] CABLE SECURITY DEVICE FOR DOOR

[76] Inventor: Laurence North, 34 Heath Park Rd., Romford, Essex, United Kingdom

[21] Appl. No.: 683,864

[22] Filed: Dec. 20, 1984

[51] Int. Cl.[5] ..... E05C 19/18

[52] U.S. Cl. ..... 292/259 R; 292/264; 292/339

[58] Field of Search ..... 292/259, 264, 339, 246; 70/30, 49, 93

[56] References Cited

U.S. PATENT DOCUMENTS

| | | | |
|---|---|---|---|
| 482,227 | 9/1892 | Conner | 292/264 |
| 1,222,920 | 4/1917 | Blais | 70/30 |
| 3,670,535 | 6/1972 | Stettner et al. | 70/30 |
| 3,980,328 | 9/1976 | Pearson | 292/259 R X |
| 4,112,720 | 9/1978 | Green | 70/30 X |
| 4,118,902 | 10/1978 | Saxton | 70/58 X |
| 4,155,577 | 5/1979 | Raymond | 70/49 X |
| 4,560,191 | 12/1985 | Grassi | 292/264 |

FOREIGN PATENT DOCUMENTS

| | | | |
|---|---|---|---|
| 928148 | 5/1955 | Fed. Rep. of Germany | 292/264 |
| 262120 | 1/1929 | Italy | 292/259 |
| 621835 | 6/1961 | Italy | 70/49 |
| 153676 | 3/1956 | Sweden | 292/264 |
| 277459 | 9/1927 | United Kingdom . | |
| 1260284 | 1/1972 | United Kingdom | 292/264 |

*Primary Examiner*—Lloyd A. Gall

*Attorney, Agent, or Firm*—Kane, Dalsimer, Sullivan, Kurucz, Levy, Eisele and Richard

[57] ABSTRACT

The security device comprises a length of cable (1) for spanning a door opening and two fixing means (2,3;4,5) secured to parts (7,8;11) defining that opening, the cable being securable at each end to the fixing means and being constructed and arranged in such a manner that the door can be moved into an ajar position, in which it engages the cable, but no further even when the door is opened with extreme force.

8 Claims, 1 Drawing Sheet

CABLE SECURITY DEVICE FOR DOOR

BACKGROUND OF THE INVENTION

This invention relates to a security device for household doors.

The vast majority of front doors for houses are provided with a Yale-type lock and, additionally, in most cases, with mortice-type locks, and, in some cases, extra door-bolt or safety chain devices.

A Yale-type lock is firmly bolted through the door but it latches into a recessed metal casing which is secured to the inside of a door jamb with, usually, three small wood screws.

A mortice-type lock on the other hand weakens the wood of the door or its frame by being let into them giving usually only 6 millimeters of wood cover to the lock. Further, these locks, no matter how expensive and elaborate, are held in position by small light gauge screws, usually four in number, and about 25 millimeters long.

That part of a safety-chain device which is secured to the door is fixed with small screws, usually four of about 12 millimeter length, and that part which is secured to the frame is held in place by only two such screws. That part of a door bolt device (even with a heavy-duty rod or bar of say 16 millimeters diameter) which is secured to the door is fixed in the same way (usually with six screws of 25 millimeters in length) and either bolts into a hole in the frame of the door (which necessarily weakens the frame) or the bolt slides into part of the device secured to the frame which is held, usually, by only two small wood screws.

All these security devices therefore suffer from the same disadvantage, namely that the door can still be forcibly opened, for example with a smart kick or by applying a shoulder to the door.

Other types of security device are in use, mainly for industrial premises, having solid bars of metal or wood which span the door and are sometimes let into the door frame, but these devices are unsightly and, further, they do not permit the door to be moved into a secure ajar position.

The present invention seeks to provide a security device which is not subject to the disadvantages referred to above, which allows the door to be moved into a secure ajar position and which makes forced entry more difficult and/or impossible.

SUMMARY OF THE PRESENT INVENTION

The present invention provides a security device comprising a length of cable for spanning a door opening and two fixing means secured to parts defining that opening, the cable being securable at each end to the fixing means and being constructed and arranged in such a manner that the door can be moved into an ajar position, in which it engages the cable, but no further even when the door is opened with extreme force.

The cable may be arranged to span the door opening top to bottom (vertically or at an angle to the vertical), or it may be arranged to span across only a part of the door opening, for example across one or more corners of the door, but it is preferred if the cable is arranged to span the width of the door opening and is arranged substantially horizontally.

Preferably, the cable is looped at one end so that it can be releasably secured to its fixing means at that end. The fixing means for receiving the looped end of the cable may then be in the form of a hook member. Although the cable ends may be secured to the fixing means in numerous ways, looping the cable in this way minimizes loss in strength of the cable which may occur in the region where it is secured to the fixing means.

Although the cable may be in the form of a rope made of fibrous material (for example, nylon) or a chain made from metal or a coiled spring, it is preferred if it is in the form of a rope comprising strands of metal, preferably steel. The cable is preferably sheathed (for example in plastics material) to avoid accidental damage to the door or its frame and/or to improve the appearance of the device.

In one form of the invention the cable is in the form of a steel cable having a diameter of 6 millimeters and at least a 2 tonne breaking strain.

The fixing means may be secured to parts of the door frame (for example the door jambs) or to parts of the brickwork or masonry surrounding the door opening. The fixing means must be substantial enough to ensure that pulling forces can be withstood even when a substantial tension (say 2 tonnes) is applied to the cable. Such anchorages are widely available for use in both timber and masonry and can be employed with the device according to the invention since they are used to provide a point of attachment for the cable and not (like the fixing screws for security bolts, locks etc.) rigidly to secure parts of the device against the door or frame and they do not materially weaken the frame or surrounding masonry (like for example recesses in the frame for receiving latches or bolts).

The fixing means may comprise a reel or spindle (for example a sprung- or inertia-spindle or reel), the cable being affixed to the reel or spindle at one end so that when it is released at its other end the cable can be wound around the spindle or reel for storage purposes. If the fixing means are secured in masonry, the spindle or reel can be let into a recess in the masonry which allows the cable to be stored out of sight.

BRIEF SUMMARY OF THE DRAWINGS

Two forms of security device each constructed in accordance with the present invention will now be described, by way of example only, with reference to the accompanying drawings in which.

DETAILED DESCRIPTION OF THE PREFERRED EMBODIMENT

Figure 1:
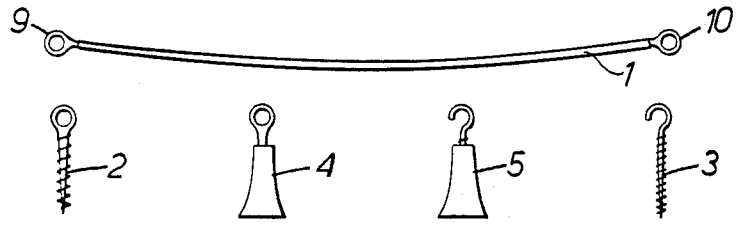
FIG. 1 diagrammatically illustrates the component parts of the two security devices.

Referring to the accompanying drawings and first of all to FIG. 1, each of the two security devices comprises a cable 1 and two fixing means. One of the devices comprises fixing means 2 and 3 for fastening in timber and the other device comprises two fixing means 4 and 5 for fastening to masonry. The length of the cable 1 for use with the fixing means 2 and 3 would be somewhat shorter—for reasons which will become apparent—than the cable used with the fixing means 4 and 5.

Figure 2:
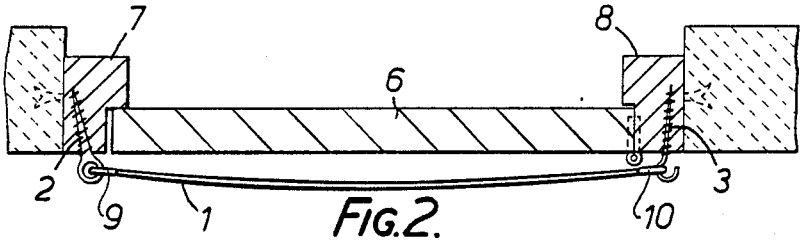
FIG. 2 is a diagrammatic plan view, partly in section, of the first device when secured to a door frame.
Figure 3:
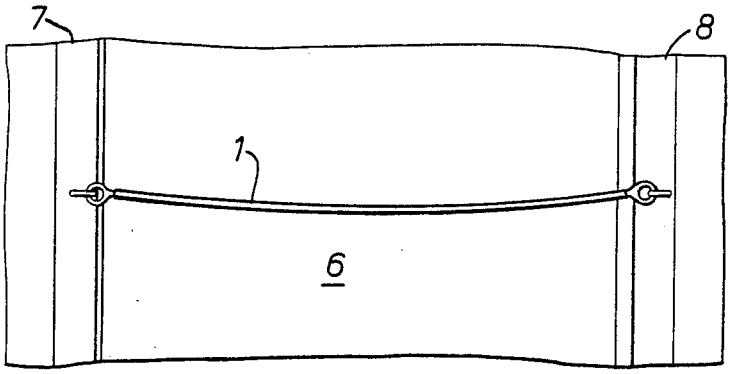
FIG. 3 is a side elevation of the first device when fixed to the door frame.

Referring now to FIGS. 2 and 3 the security device comprising the cable 1 and fixing means 2 and 3 is mounted across the rear of a door 6 arranged in a frame comprising jambs 7 and 8. The door is hinged to the jamb 7 and may be locked to the jamb 8 using conventional Yale-type locks, mortice-type locks, etc.

The fixing means 2 which is in the form of an eye-screw or an eye-bolt is secured into the door jamb 7 and the fixing means 3 which is in the form of a hook-screw or hook-bolt is mounted in the door jamb 8.

Each end of the cable 1 is provided with a loop 9, 10, the loop 9 being securely held in the eye of the screw or bolt 2 and the loop 10 being mounted over the hook of the fixing means 3.

As will be evident (especially from FIG. 3) the cable then spans the width of the door opening with the cable 1 lying substantially horizontally. As will be seen from FIG. 2 the cable is spaced at a small distance from the rear face of the door. That small spacing and/or the provision of a small degree of slack in the cable when it is fastened as illustrated allows the door to be moved into a secure ajar position in which it engages the cable. For example, the door may be moved into an ajar position in which an opening is provided between the door and its frame of say about 8 millimeters. It is not possible to open the door beyond that ajar position, however, even if considerable force is applied to the door, because the cable and its two anchorages will resist such movement.

Figure 4:
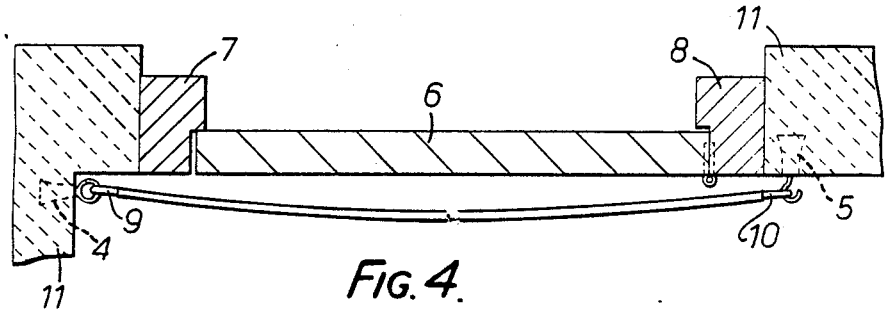
FIG. 4 is a plan view, partly in section, of the second device when fixed to masonry surrounding the door opening, and FIG. 5 diagrammatically illustrates the device in its storage condition.

FIG. 4 shows a plan view similar to that of FIG. 3 where the fixing devices 4 and 5 have been used to mount the cable 1 across the rear of the door, the fixing means 4 and 5 having been fastened to masonry 11 adjacent to the door opening. As shown in FIG. 4 the fixing means 5 is fastened in masonry directly adjacent to the door jamb 8 while the fixing means 4 has been secured in masonry (which may for example be an internal wall of the house), spaced further away from the door jamb 7.

Figure 5:
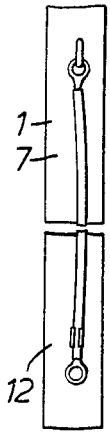

FIG. 5 illustrates the security device in its storage or non-operative condition. As shown in that figure the loop 10 has been disengaged from the hook of the fastening means 3 or 5 which allows the cable 1 to be arranged in a vertical condition, for example, as shown, along the length of the door jamb 7, where it may be held in position by a spring clip 12.

The cable 1 is preferably a steel cable and its diameter is selected in accordance with the width of the door. For example, a 6 millimeter diameter steel cable will be suitable for a door having a width of 75 centimeters.

The fixing means 2, 3 and 4, 5 described and illustrated can have a substantial length (as shown in FIG. 2 they can extend through a major portion of the door jamb) to provide a suitable anchorage for the cable consistent, for example, with resisting say a 2 tonne breaking strain applied to the cable 1. For example, each of the fixing means may be at least 70 millimeters long and may be 6 millimeters to 8 millimeters in diameter.

It will be appreciated from the description above that if forcible entry is attempted through the door the force applied to the door is transferred by at least a major portion of the width of the door to the cable and then to the anchorages.

Forcible entry, therefore, is only possible by exceeding the working load of the anchorages or by snapping the cable or by smashing the door. Any one of those methods would be very difficult to accomplish, would take some considerable time and would cause great disturbance allowing the occupier either to raise the alarm or, if necessary, to escape.

I claim:

1. A security device comprising means defining a door opening and a door coupled thereto for opening and closing the opening, a length of cable of fixed length spanning the door opening and two fixing means secured to parts defining that opening, the cable being securable at each end to the fixing means and being constructed and arranged in such a manner that a small degree of slack is provided so that the door can be moved into an ajar position to permit a room occupant to view a person at the door when the door is in the ajar position, in which it engages the cable, but no further even when the door is opened with extreme force, which force is transferred by at least a major portion of the width of the door to the cable and the fixing means so that security of the door is maintained while the door is closed and in the ajar position.

2. A security device as claimed in claim 1, wherein the cable is arranged to span the width of the door opening.

3. A security device as claimed in claim 1, wherein the cable is looped at one end so that it can be releasably secured to its fixing means at that end.

4. A security device as claimed in claim 3, wherein the fixing means for receiving the looped end of the cable is in the form of a hook member.

5. A security device as claimed in claim 1, wherein the cable is in the form of a rope comprising metal.

6. A security device as claimed in claim 5, wherein the cable is sheathed.

7. A security device as claimed in claim 1, wherein the cable is a steel cable having a diameter of 6 millimeters and at least a 2 tonne breaking strain.

8. A security device as claimed in claim 1, wherein each fixing means comprises an anchorage for securing to timber or masonry surrounding the door opening.

* * * * *